United States Patent [19]

Domino et al.

[11] Patent Number: 5,001,643

[45] Date of Patent: Mar. 19, 1991

[54] ADAPTIVE AIR FLOW CORRECTION FOR ELECTRONIC ENGINE CONTROL SYSTEM

[75] Inventors: Robert F. Domino, Livonia; Kevin M. Flannery, Dearborn, both of Mich.

[73] Assignee: Ford Motor Company, Dearborn, Mich.

[21] Appl. No.: 357,151

[22] Filed: May 26, 1989

[51] Int. Cl.[5] ..... F02M 51/00

[52] U.S. Cl. ..... 364/431.06; 123/489; 123/440; 73/118.2; 364/431.05

[58] Field of Search ..... 364/431.05, 431.06; 123/440, 489, 463; 73/119 A, 118.2

[56] References Cited

U.S. PATENT DOCUMENTS

| | | | |
|---|---|---|---|
| 4,430,976 | 2/1984 | Kondo et al. | 364/431.06 |
| 4,683,858 | 8/1987 | Sato et al. | 73/118.2 |
| 4,748,956 | 6/1988 | Iwaki | 123/440 |
| 4,763,629 | 8/1988 | Okazaki et al. | 123/440 |
| 4,773,016 | 9/1988 | Abe et al. | 364/431.05 |
| 4,789,939 | 12/1988 | Hamburg | 364/431.05 |
| 4,823,270 | 4/1989 | Nagai | 364/431.05 |

*Primary Examiner*—Parshotam S. Lall
*Assistant Examiner*—Michael Zanelli
*Attorney, Agent, or Firm*—Peter Abolins; Clifford L. Sadler

[57] ABSTRACT

Air flow determination for an electronically controlled engine includes measuring air flow, determining a correction multiplier, correcting the air flow measurement, and determining if the correction multiplier needs to be updated.

3 Claims, 2 Drawing Sheets

ADAPTIVE AIR FLOW CORRECTION FOR ELECTRONIC ENGINE CONTROL SYSTEM

BACKGROUND OF THE INVENTION

1. Field of the Invention

This invention relates to electronic engine controls, particularly those having an air flow meter.

2. Prior Art

Electronic engine control using sensors and actuators coupled to a computer processing unit is known. For example, it is known to determine a voltage representative of air flow into the engine and apply it to a central electronic engine control module. A transfer function or stored table within the control module transforms the actual received voltage into an air flow measurement. Typically, a fuel calculation using the derived air flow is then performed to determine the amount of fuel to be supplied to the engine. However, it has been found that it is desirable to correct the value of the calculated fuel. That is, the air flow may not be sufficient to provide a sufficiently adequate determination of fuel. For example, a memory associated with the central computer processor may store a correction multiplier which can be applied to the fuel calculation to get a corrected fuel calculation. The correction multiplier may be stored as a function of engine load and/or engine RPM. The correction multiplier can be applied to the fuel calculation as a multiplier and a corrected fuel calculation derived.

The above methodology may be undesirable because the correction multiplier is stored as a function of load which is a calculated value. Such a calculation introduces inaccuracies and takes time. Accuracy may be lost because of rounding off during multiplication and because of the change in engine conditions due to the passage of time since the initial voltage was supplied to the electronic engine control module. Also, the table storing the correction multiplier is typically a three dimensional table which uses storage space, requires two inputs and has a calculated output.

It would be desirable to have increased accuracy, require less storage space, and a reduced cost of memory and processing equipment. These are some of the problems this invention overcomes.

Fuel injected systems may exhibit vehicle to vehicle steady state air fuel ratio errors due to normal variability in system components. Accordingly, an adaptive air flow strategy would be desirable to address this problem. For example, such a system can store the characteristics of the individual system components. This stored information can be used to predict what the system will do based on past experience. Such an ability to predict system behavior improves both open loop and closed loop fuel control. For example, the stored information can be used on cold starts to achieve better open loop fuel control before an exhaust gas oxygen sensor reaches operating temperature to supply information about the air fuel ratio of the engine during operation. Accordingly, a benefit of such an adaptive strategy is to reduce the effects of product variability.

SUMMARY OF THE INVENTION

In accordance with an embodiment of this invention a voltage reading from an air flow meter is applied to a stored information array to generate a correction value for the air flow meter reading. The corrected air flow reading can be used in any future computations necessary to determine the amount of fuel to be supplied to the engine. An equivalence ratio is computed as the ratio of the actual air/fuel ratio to the stoichiometric air/fuel ratio. The computed equivalence ratio is compared to the ideal equivalence ratio which is 1.0. This comparison is used to determine if updating of the information stored in the array is necessary. Advantageously, the output of the EGO sensor is also considered when deciding to update the information.

BRIEF DESCRIPTION OF THE DRAWINGS

FIG. 3B1 is a corrected array cell for use in the electronic engine control of FIG. 2;

FIG. 3B2 is an array cell for interpolation between two array cells to get a modifier for use with the electronic engine control of FIG. 2;

DETAILED DESCRIPTION OF THE INVENTION

Figure 1:
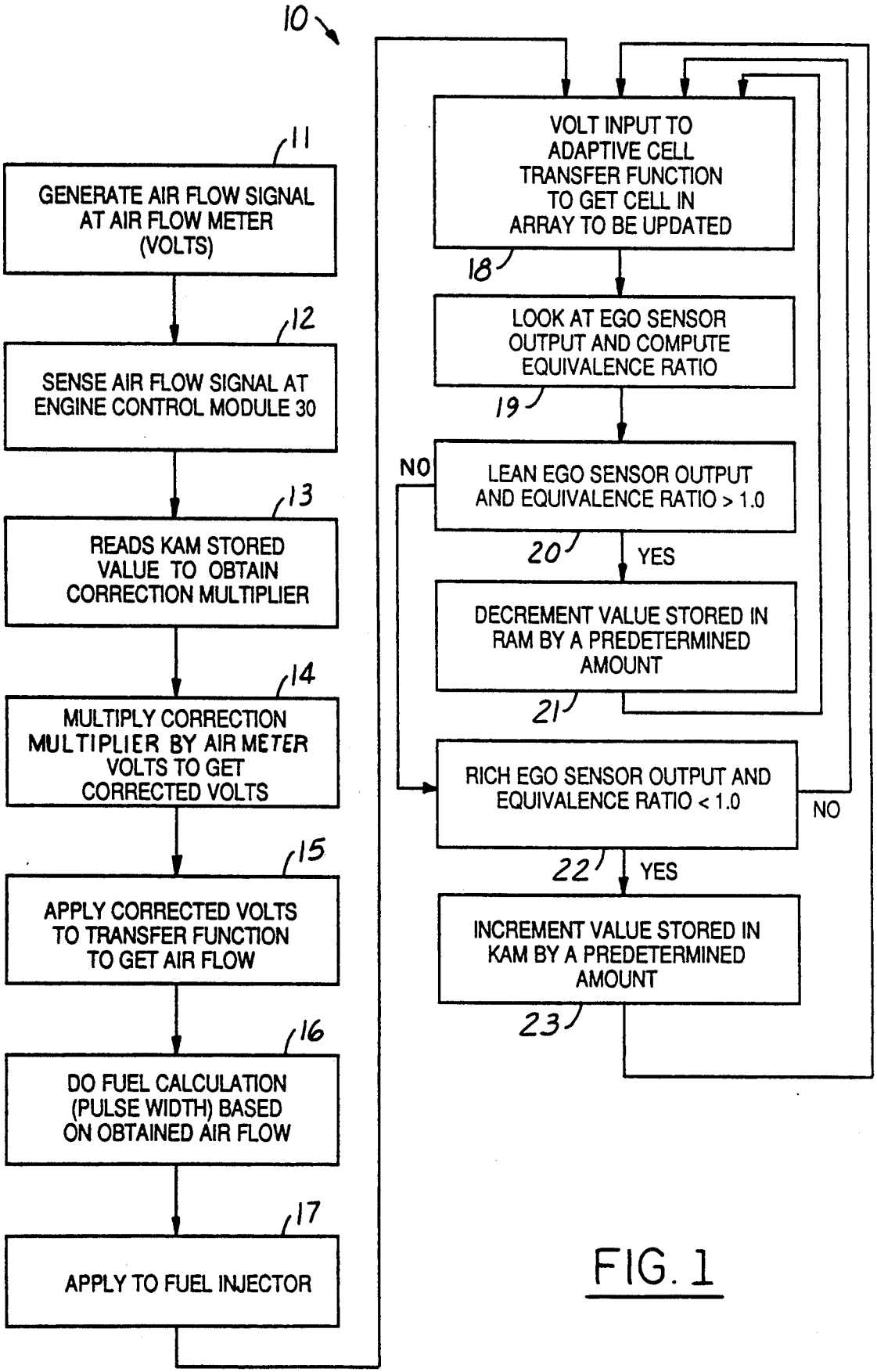
FIG. 1 is a logic flow diagram of an adaptive air control system in accordance with an embodiment of this invention.

Referring to FIG. 1, a correction logic flow 10, begins with reading an air mass flow using an air flow meter generating an output voltage as indicated at block 11. The output voltage in block 11 is applied to an electronic engine control input at block 12. Logic flow from block 12 is to a block 13 which reads the memory of the electronic control computer to obtain the correction multiplier.

Figure 2:
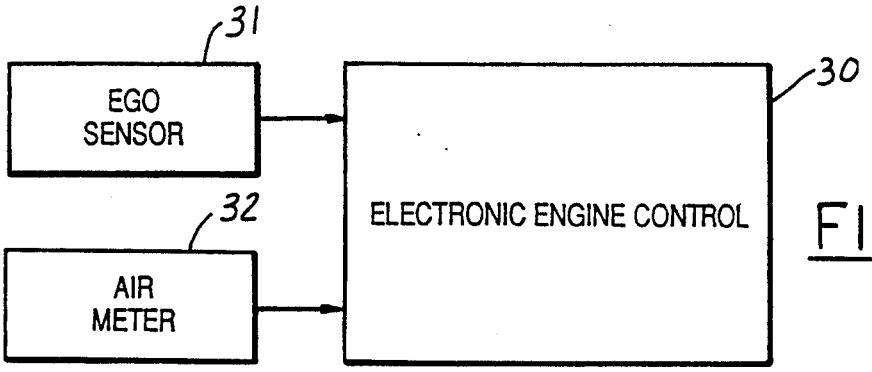
FIG. 2 is a block diagram of an adaptive air control system in accordance with an embodiment of this invention.
Figure 3A:
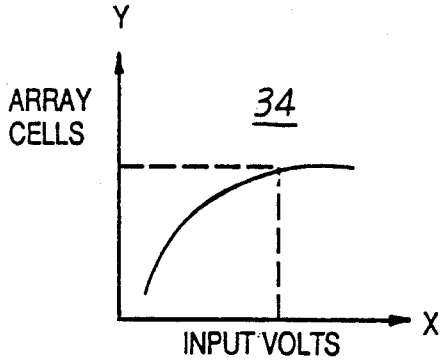
FIG. 3A is a graphical representation of input volts versus array cells for use in the electronic engine control of FIG. 2.
Figure 3C:
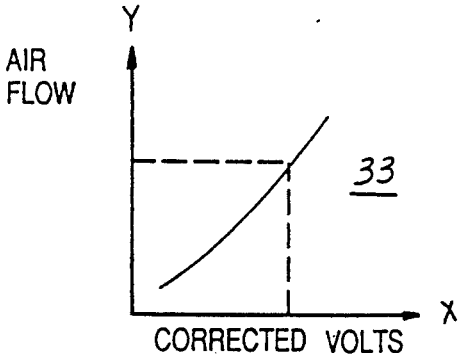
FIG. 3C is a graphical representation of air flow as a function of corrected volts.
Figure 3D:
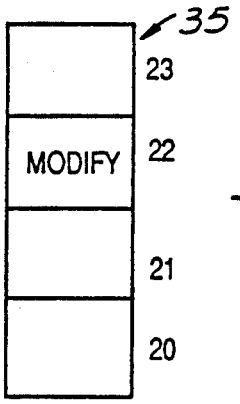
FIG. 3D is a flow diagram of the steps of getting a fuel flow from air flow.
Figure 3D:
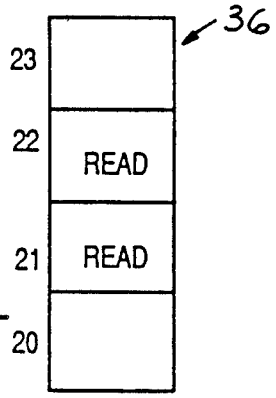
Figure 3D:
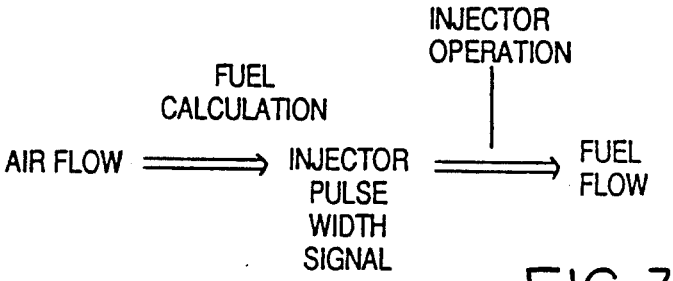

Referring to block 13, the input received by the electronic engine control computer from the air flow meter is applied to stored memory array function 34 to determine which cells in stored memory arrays 35 and 36 (FIG. 2) are to be used as the correction multipliers. If the cell value returned by function 34 is a mixed number, the correction multiplier to be used is an interpolation of the stored values in the memory of adjacent cells.

For example, if the voltage reading from the air meter is 3.1 volts, the resulting output can be a cell number 21.669. The correction multiplier used is an interpolation of the values stored in the memory of adaptive cells 21 and 22.

From block 13 logic flows sequentially to blocks 14, 15, 16 and 17. At block 14, the correction multiplier is multiplied by the voltage supplied by the air flow meter to get a corrected voltage. At block 15, the corrected voltage is applied to a transfer function to determine an air flow. At block 16, a fuel calculation is done to determine the pulse width of the signal to be applied to the fuel injector as a function of the air flow obtained at block 15. At block 17, the signal generated at block 16 is applied to the fuel injector.

From block 17 logic flows to an update logic path segment starting at block 18, where the voltage received from the air flow meter has been used by an adaptive cell transfer function 34 to determine the cell in the array which has to be updated. After block 18, a check is done as to whether such updating should occur, at block 19 the exhaust gas oxygen (EGO) sensor output is detected and an equivalence ratio is computed. The equivalence ratio is a normalized air fuel ratio, sometimes called LAMBDA, and is defined by the actual air fuel ratio divided by the stoichiometric air fuel ratio.

From block 19 logic flows to a block 20 where a determination is made to see if there is a correlation between a lean ego sensor output and a calculated equivalence ratio which is greater than one. If there is a correlation at block 20, then the logic flows to block 21 where a correction is made to the value stored in the memory of the adaptive cell by decrementing it a predetermined amount. Logic flow from block 21 goes back to block 18.

If there is no correlation at block 20, then the logic flows to block 22 where a determination is made whether there is a correlation between a rich EGO sensor output and a calculated equivalence ratio which is less than one. If there is a correlation at block 22, then the logic flows to block 23 where a correction is made to the value stored in the memory of the adpative cell by incrementing it a predetermined amount. Logic flow from block 23 goes back to block 18. If there is no correlation at block 22, logic flow goes back to block 18.

Referring to FIG. 2, FIGS. 3A, 3C, 3B1, 3B2 and 3D, an electronic engine control module 30 includes a central processor and memory and executes correction logic flow 10 shown in FIG. 1. Inputs to module 30 are provided by an EGO sensor 31 and an air meter 32. Processing within module 30 determines air flow as a function of corrected volts in a transfer function 33 and determines fuel flow from the air flow using another calculation. A transfer function 34 is used to determine the array cell as a function of input air meter volts so that the corrected array cell is then corrected.

Adaptive arrays 35 and 36 are one dimensional arrays of learned system corrections. Typically one such array is used for each EGO sensor, so that systems with two EGO sensors use two arrays. In operation, ideally, if the calculated equivalence ratio is equal to one for both arrays and the arrays are mature, in the sense that they are corrected arrays operating in a system which has stabilized, a stoichiometric air fuel ratio would result at whatever mass air point adaptive learning had taken place. A typical size for each such an adaptive array is $1\times32$ cells. During adaptive learning, only the cells of arrays 35 and 36 are modified. The ranges of the learned cell values are 0.0 to 2.0.

The voltage reading from air meter 32 is applied to the engine control module 30, and in particular, transfer function 34. Thus, the input is on the X axis is the voltage out of air meter 32 and the output on the Y axis determines which cell should be updated. The output is a cell number which consists of an integer and decimal portion. The number is then rounded to the nearest integer and the result is the cell to be updated.

For example, if the voltage reading from air meter 32 is 3.1 volts, the resulting output can be a cell number 21.669 which becomes 22 after rounding.

The frequency of these updates is determined by an engine rotational reference signal (PIP) and the number of times the EGO sensor has switched. However, no update is made if the value stored in the memory of the adaptive cell is at minimum (MNADP) or maximum (MXADP) values.

The adaptive data is referenced in both closed loop and open loop modes.

The conditions to be met include:

LOGIC FOR EGOm PIP COUNTER UPDATE

EGOCTm >OR= ADEGCT
(EGO switching counter (EGOCTm) must be greater than a fixed number of times defined as ADEGCT)
LAMBSEm >OR= 1 + DELAMB
LAMBSEm <OR= 1 − DELAMB
(Lambda, i.e. a calculated equivalence air fuel ratio, must be outside a deadband value about the normalized air fuel ratio defined by ± DELAMB)

-OR-

-AND-

If this output is "1" (true) then Increment PIPCTm (PIP counter)

LOGIC TO UPDATE CELLS

EGOm IS LEAN
LAMBSEm >1.0
PIPCTm > ADUDR
(PIP counter greater than a fixed value, ADUR)
KAMAmn > MNADP
(value in keep alive cell mn greater than a minimum value defined as MNADP)

-AND-

If this output is "1" (true) then

KAMAmn = KAMAmn − 1 bit
PIPCTm = 0
EGOCTm = 0

If "false" (output is "0"), then
-else-

-continued

EGOm IS RICH
LaMBSEm <1.0
PIPCTm > ADUDR
(PIP counter greater than a fixed value)
KAMAmn > MXADP
(value in keep alive cell mn less than a maximum value defined as MXADP)

-AND-

If this output is true, then
KAMAmn = KAMAmn + 1 bit
PIPCTm = 0
EGOCTm = 0 n indicates cell number to update as determined by function 34 (FIG. 2)
m indicates the number of the EGO sensor being looked at
After each update the counters are reset to 0.

Adaptive data is referenced in both closed and open loop modes.

Various modification and variations will no doubt occur to the skilled in the art to which this invention pertains. For example, the particular architecture of the electronic engine control module may be varied from that disclosed herein. These and all other variation which basically rely on the teachings through which this disclosure has advanced the art are properly considered within the scope of this invention.

We claim:

1. A method adaptively correcting air flow measurement for an internal combustion engine controlled by an electronic engine control computer including the steps of:

generating a voltage as a function of a measured air flow;

detecting the generated control by an electronic engine control module;

determining memory locations in the voltage module as a function of the detected voltage;

obtaining stored correction values from the memory locations;

interpolating between the stored values to obtain a correction multiplier;

multiplying the detected voltage by the correction multiplier to determine a corrected voltage;

determining an air flow into the engine using a stored transfer function as a function of the corrected voltage;

calculating a fuel injector pulse width as a function of the determined air flow;

applying the calculated fuel injector pulse width to a fuel injector;

sensing the amount of oxygen in the exhaust gas of the engine;

calculating an equivalence ratio as a function of the sensed oxygen;

comparing the calculated equivalence ratio to an ideal equivalence ratio of 1.0;

updating the stored correction multiplier if the result of the comparison of the calculated equivalence ratio is less than or greater than the ideal equivalence ratio, the calculated equivalence ratio value is outside a predetermined range, and the sensed EGO voltage output indicates the same rich or lean condition as the calculated equivalence ratio;

determining if the exhaust gas oxygen sensor has switched between indicating rich and lean more than a predetermined number of times;

determining if the equivalence ratio is outside a deadband range;

decrementing the correction multiplier if the calculated equivalence ratio is lean of stoichiometry; and incrementing the correction multiplier if the calculated equivalence ratio is rich of stoichiometry.

2. A method of adaptively correcting air measurement as recited in claim 1 wherein;

decrementing the correction multiplier is done only if the value of the correction multiplier is greater than a predetermined minimum value; and incrementing the correction multiplier is done only if the value of the correction multiplier is less than a maximum value.

3. A method adaptively correcting air flow measurement for an internal combustion engine controlled by an electronic engine control computer including the steps of:

generating a voltage as a function of a measured air flow;

detecting the generated voltage by an electronic engine control module;

determining memory locations in the control module as a function of the detected voltage;

obtaining stored correction values from the memory locations;

interpolating between the stored values to obtain a correction multiplier;

multiplying the detected voltage by the correction multiplier to determine a corrected voltage;

determining an air flow into the engine using a stored transfer function as a function of the corrected voltage;

calculating a fuel injector pulse width as a function of the determined air flow;

applying the calculated fuel injector pulse width to a fuel injector;

sensing the amount of oxygen in the exhaust gas of the engine;

calculating an equivalence ratio as a function of the sensed oxygen;

comparing the calculated equivalence ratio to an ideal equivalence ratio;

updating the stored correction multiplier if the result of the comparison of the calculated equivalence ratio is less than or greater than the ideal equivalence ratio, the calculated equivalence ratio value is outside a predetermined range, the sensed EGO voltage output indicates the same rich or lean condition as the calculated equivalence ratio;

determining if the exhaust gas oxygen sensor has switched between indicating rich and lean more than a predetermined number of times;

determining if the calculated equivalence ratio is outside a deadband range;

decrementing the correction multiplier if the calculated equivalence ratio is lean of stoichiometry and only if the value of the correction multiplier is greater than a predetermined minimum value; and incrementing the correction multiplier if the calculated equivalence ratio is rich of stoichiometry and only if the value of the correction multiplier is less than a maximum value.

* * * * *